US005441514A

United States Patent [19]

Durham

[11] Patent Number: 5,441,514

[45] Date of Patent: Aug. 15, 1995

[54] APPARATUS AND METHOD FOR PIERCING EARS

[75] Inventor: Tony Durham, High Wycombe, United Kingdom

[73] Assignee: Perfex (U.K.) Limited, Aylesbury, United Kingdom

[21] Appl. No.: 156,581

[22] Filed: Nov. 23, 1993

[51] Int. Cl.[6] ..... A61B 17/34

[52] U.S. Cl. ..... 606/188

[58] Field of Search ..... 606/187, 188; 124/37

[56] References Cited

U.S. PATENT DOCUMENTS

| | | | |
|---|---|---|---|
| 3,943,935 | 3/1976 | Cameron . | |
| 4,020,848 | 5/1977 | DiCicco . | |
| 4,030,507 | 6/1977 | Mann . | |
| 4,931,060 | 6/1990 | Aué | 606/188 |
| 5,004,471 | 4/1991 | Mann | 606/188 |
| 5,211,653 | 5/1993 | Nakajima | 606/188 |

FOREIGN PATENT DOCUMENTS 2187960 9/1987 United Kingdom .

2235385 9/1993 United Kingdom .

*Primary Examiner*—Stephen C. Pellegrino
*Assistant Examiner*—William Lewis
*Attorney, Agent, or Firm*—Fulwider Patton Lee & Utecht

[57] ABSTRACT

There is described a cartridge for an ear piercing apparatus comprising a clasp-holding member provided with means for holding a clasp of a stud assembly and a stud-holding member provided with means for holding a stud of the stud assembly, one of the members having a guide formation which co-operates with a complimentary guide formation provided on the other of the members so as to facilitate the relative of movement of the members in a direction generally parallel to the longitudinal axis of the stud when held by the stud-holding member, said means for holding the clasp comprising means defining a slot within the clasp-holding member for the receipt of the clasp and retaining means for engagement with the clasp when the clasp is received within the slot.

20 Claims, 4 Drawing Sheets

FIG. 1
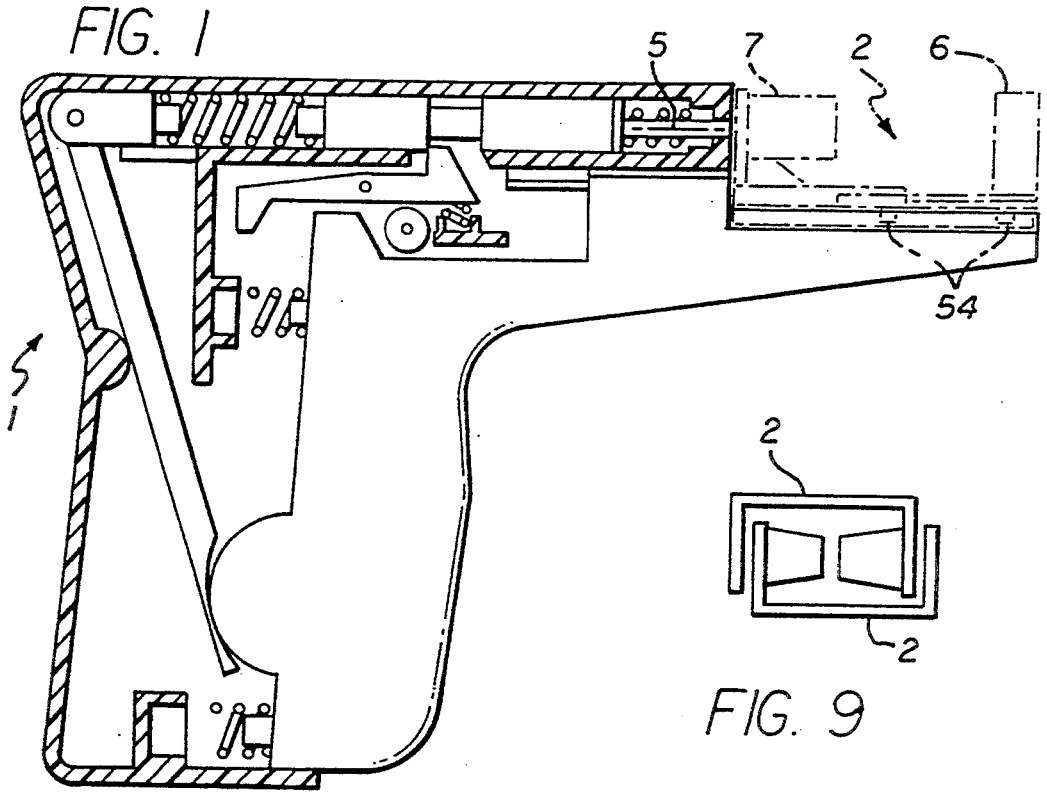
FIG. 9
FIG. 2
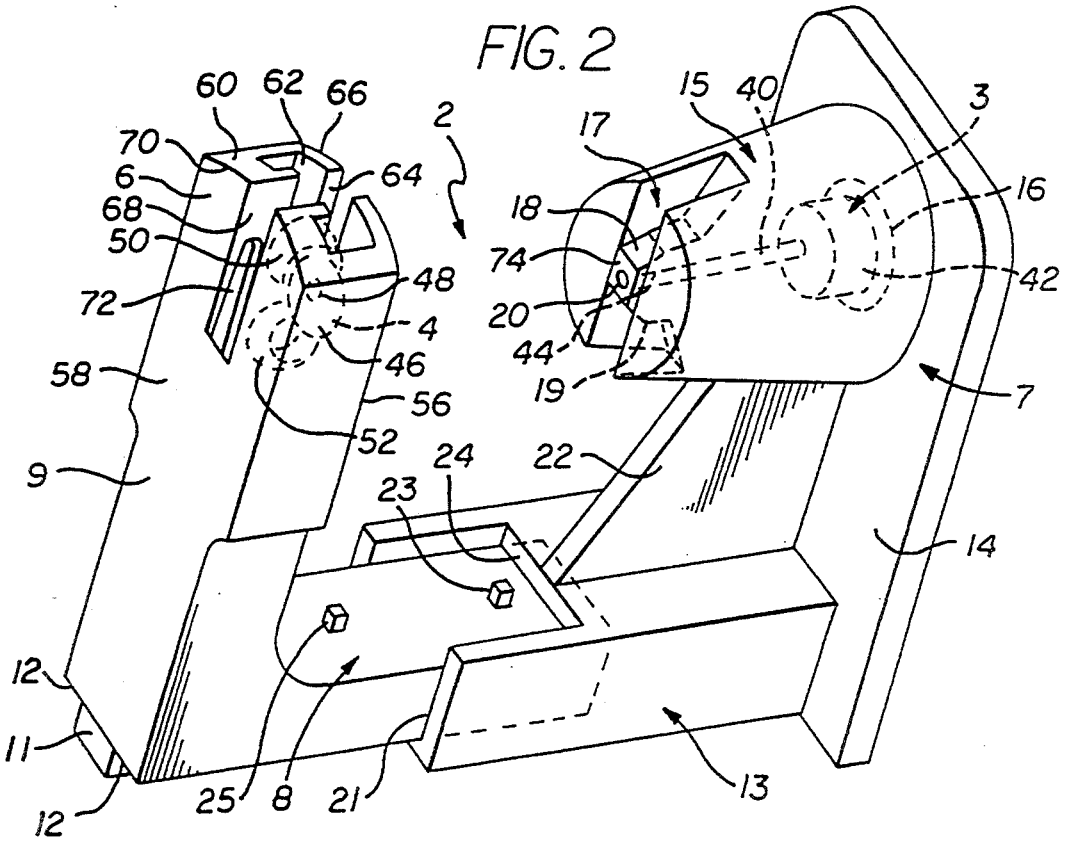

APPARATUS AND METHOD FOR PIERCING EARS

The present invention relates to an apparatus and a method for the piercing of ears in which an ear piercing stud is driven through an ear to engage a clasp.

It is known to provide a projector in which an ear piercing stud is propelled from a stud-holder towards a clasp held in a clasp-holder, the stud having a pointed end portion for both piercing the ear and engaging the clasp. Typically such a projector may be of the pistol type having a plunger to engage the stud, propulsion means to propel the plunger, means to restrain the plunger against the propulsion means and a trigger by which the user can release the restraining means to allow the plunger and the stud carried thereby to be propelled against the ear lobe.

Since ear piercing commonly results in one or two drops of blood being released from the ear lobe, the use of this conventional method very often results in traces of blood being deposited onto the surfaces of the projector which come into contact with the ear lobe during the ear piercing operation. Although rigorous washing of the projector after an ear piercing operation can sometimes remove the blood, this does not always take place and traces of blood may remain on the projector from one ear piercing operation to the next. As a result there is a substantial risk of infection being transmitted from one person to another when using this conventional method.

In the past it has been recognised that in order to avoid this risk of infection not only should those parts of the projector which come into contact with the ear be sterilised but so also should the stud and clasp themselves. To this end there have been proposed a number of designs of cartridge which can be fitted to a projector with the stud and clasp already loaded. In this way it has been possible to avoid the need for the person conducting the ear piercing operation to manually load the projector with the stud and clasp thereby increasing the aseptic nature of the whole ear piercing operation.

One such cartridge design is described in UK Patent No. 2,235,385 as comprising two relatively moveable components which respectively hold the stud and clasp and which do not have to be manually moved apart before being fitted to the projector.

Unfortunately however, because of the need to design the clasp-holder in such a way that the clasp may be easily removed once it has been engaged by the stud, there has been a tendency for the various designs of clasp-holder to retain the clasp rather too loosely. As a result it is not uncommon for the clasp to simply fall out of the clasp-holder before the ear piercing operation has been completed thereby necessitating its manual reloading by the person conducting the ear piercing operation. Clearly, such an occurrance removes all the benefits of providing the stud and clasp in a manner in which they are already loaded in respective portions of an ear piercing cartridge.

Likewise it is not uncommon for the stud to be accidentally displaced from the stud-holder. It is therefore an aim of the present invention to provide a an apparatus and method for the piercing of ears in which the stud and clasp are securely retained within an ear piercing cartridge and yet are easily removed therefrom once the ear piercing operation has been completed and the clasp has been engaged by the stud.

According to a first aspect of the present invention there is provided a cartridge for an ear piercing apparatus of the type comprising means to propel a stud through an ear and into engagement with a clasp, said cartridge comprising a clasp-holding member having means for holding the clasp, and a stud-holding member having means for holding the stud, one of said members having a guide formation which cooperates with a complimentary guide formation provided on the other of said members so as to facilitate relative movement of said members in a direction generally parallel to the direction of propulsion of the stud, said means for holding the clasp comprising means defining a slot within the clasp-holding member for the receipt of the clasp and retaining means for releasable engagement with the clasp when the clasp is received within the slot.

A number of embodiments of the present invention will now be described by way of example with reference to the accompanying drawings in which:

FIG. 1 is a lateral side view of an ear piercing gun fitted with a cartridge in accordance with an embodiment of the present invention in which part of the gun has been broken away for the sake of clarity;

FIG. 2 is a schematic perspective view of an ear piercing cartridge in accordance with a first embodiment of the present invention;

FIG. 9 is a schematic illustration of the packing arrangement of a pair of cartridges each of which is in accordance with an embodiment of the present invention.

Figure 4:
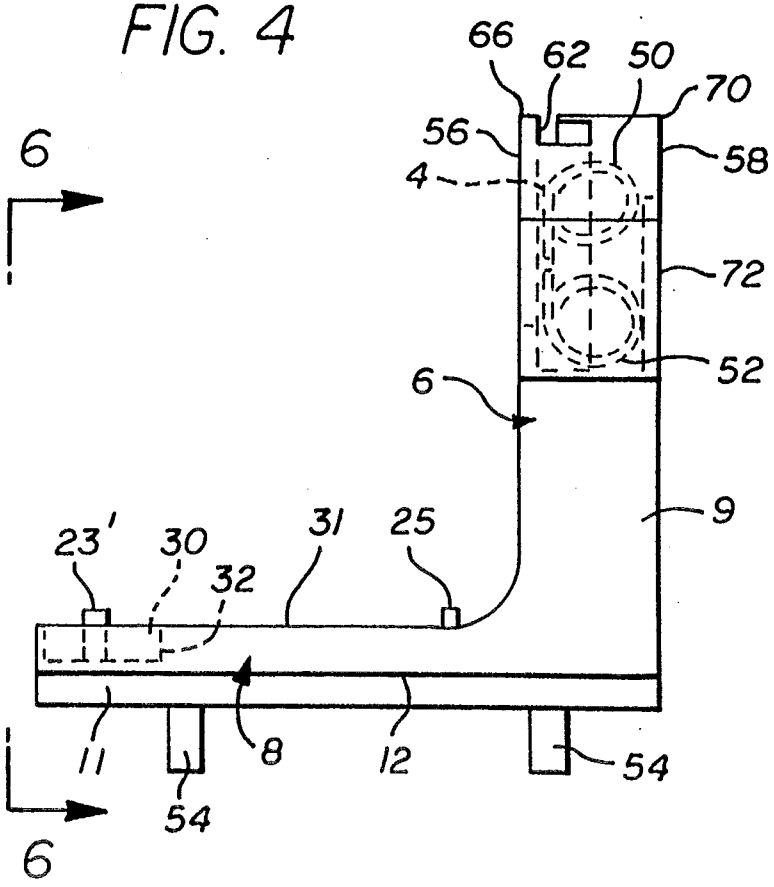
FIG. 4 is a lateral side view of a clasp-holding member of a cartridge in accordance with a second embodiment of the present invention.

Referring to FIG. 1 there is shown an ear piercing gun 1 fitted with a disposable ear piercing cartridge 2. The cartridge 2 contains an ear piercing stud 3 and a clasp 4 and is provided on an underside with one or more pegs 54 that serve to retain and locate the cartridge to the gun 1.

As is conventional, the stud 3 comprises a shaft 40 having an enlarged head 42 at one end and a point 44 at the other. Likewise, as is also conventional, the clasp 4 comprises a disc 46 having a central aperture 48 and two diametrically oppositely disposed arcuate spring portions 50 and 52 that extend rearwardly from the perimeter of the disc 46 to terminate close to the aperture 48.

In contrast to the cartridge 2, the gun 1 is provided with a spring powered reciprocating plunger 5 for driving the point of the stud 44 through the the ear be pierced and into engagement with the central aperture of the clasp 48. In the embodiment shown, the gun 1 is provided with an internal sheer mechanism which automatically fires the plunger 5 when a combined spring-loading and firing trigger has been compressed beyond a predetermined point. It will of course be appreciated however that the gun could have a firing trigger which is distinct from the spring-loading trigger and which is operable separately therefrom.

Turning to FIG. 2, the cartridge 2 may be seen to comprise a clasp-holding member 6 which is slideably moveable with respect to a stud-holding member 7. Both the clasp-holding member 6 and the stud-holding member 7 are substantially L-shaped with the clasp-holding member 6 comprising a longitudinally extending foot portion 8 from one end of which there projects an upright post portion 9.

The post portion 9 is comprised of opposed front and back faces 56 and 58 and is provided in an upper end surface 60 with a transverse slot 62 which communicates with an elongate cut-away portion 64 provided in the front face 56, the cut-away portion 64 extending from the centre of an upper edge 66 downwardly to a point approximately two thirds of the height of the post portion 9. The transverse slot 62 also communicates with a similar elongate cut-away portion 68 provided in the back face 58, the second cut-away portion 68 being in alignment with the first 64 and extending from the centre of an upper edge 70 downwardly to a point somewhat below the termination of the first cut-away portion at approximately half the height of the post portion 9. At the termination of the second cut-away portion 68 there is provided a projecting finger 72 which extends upwardly within the second cut-away portion 68 and substantially co-planar with the back face 58 so as to almost close the said cut-away portion 68. As shown in FIG. 2 however, the projecting finger 72 has a transverse dimension at the termination of the cut-away portion 68 which is insufficient to completely close the cut-away portion and which tapers to a rounded point at the opposite end of the finger at a height of approximately three quarters of that of the cut-away portion itself.

By contrast, the foot portion of the clasp-holding member 8 is provided on an under surface with a longitudinal rib or a tongue 11 which, with the shoulders 12 located on either side of the rib 11, serve to guide the clasp-holding member 6 and the stud-holding member 7 for relative movement.

In addition to the longitudinal rib 11, the foot portion 8 is provided on an opposed upper surface with a frangible projecting stop 23 which is adapted to abutt a shoulder 24 provided on the stud-holding member 7 and which serves to prevent the members moving towards each other closer then a predetermined distance. A second projecting stop 25 is also provided on the upper surface at a location between the first projecting stop 23 and the post portion 9 and serves to define an end stop on the breaking of the first projecting stop 23.

As has been previously mentioned, as well as the longitudinal rib 11 and projecting stops 23 and 25, the foot portion 8 is also provided on the under surface with one or more pegs 54 which serve to locate the entire clasp-holding member 6, and thus the cartridge 2, with respect to the gun 1.

Turning now to the other member of the cartridge 2, the stud-holding member 7 is provided with a longitudinally extending foot portion 13 which terminates at an end remote from the clasp-holding member 6 in an upwardly extending wall portion 14. A frustroconical stud housing 15 is provided on the wall portion 14 spaced from, but with its longitudinal axis extending generally parallel to, the foot portion 13. Coaxial with this axis the stud housing 15 is provided with a generally cylinderical through bore 16 having a diameter that is complimentary to that of the head of the stud 42 which it holds. At an end of the housing 15 remote from the wall portion 14, the housing is provided with a slot 17 having a transverse dimension similar to that of the diameter of the bore 16. Within the slot 17 the housing 15 is provided with a bow-shaped portion 18 formed by two oppositely inclined but forwardly extending arms 19 which serve to define a guide for the passage of the stud 3. The two arms 19 are interconnected by a web 74 thereby partially closing off one end of the through bore 16. The web 74 however, is in turn provided with an aperture 20 for the receipt of the pointed end 44 of the stud 3, the engagement with which serves to retain the stud with respect to the stud-holding member 7.

In addition to the stud housing 15, the foot portion 13 of the stud-holding member 7 serves to define a channel 21 having an internal cross-section which is complimentary to the external cross-section of the foot portion 8 of the clasp-holding member 6. As a result the foot portion 8 of the clasp-holding member 6 may be slideably received within the channel 21.

A reinforcing buttress 22 interconnects the wall portion 14, the stud housing 15 and the foot portion 13.

In use the stud and clasp are both contained within the cartridge 2 with the stud 3 retained in the stud-holding member 7 and the clasp 4 retained in the clasp-holding member 6. In particular, the stud 3 is received within the through bore 16 of the stud housing 15 with the head of the stud 42 generally flush with the wall portion 14 and the pointed end 44 in engagement with the aperture 20.

By contrast, the clasp 4 is received within the transverse slot 62 with the central aperture accessible through the front cut-away portion 64 and the two arcuate spring portions 50 and 52 received within the second cut-away portion 68. With the clasp 4 in this position the projecting finger 72 is forced rearwardly out of the plane of the back face 58 by virtue of its contact with at least the lower of the two arcuate spring portions 50 or 52. However, the partially resilient nature of the projecting finger 72 ensures the creation of a force on the arcuate spring portions 50 and 52 which tends to restore the projecting finger 72 to its natural position co-planar with the back face 58 and which simultaneously serves to retain the clasp 4 within the transverse slot 62. Thus even if the clasp-holding member 6 were to be inverted and subjected to prolonged vibration the clasp 4 would not fall out and so compromise the aseptic nature of the ear piercing operation.

The pre-loaded cartridge 2 is sterilised and may be provided in a blister pack in nested pairs as shown in FIG. 9. Alternatively, each cartridge 2 may be packaged individually.

Using a projector such as that shown in FIG. 1, an ear may be pierced in accordance with the following method:

A sterile pack containing a pre-loaded cartridge 2, is opened and the cartridge fitted to the ear piercing gun 1 by means of the insertion of the or each of the pegs 54 within a corresponding number of complimentary blind bores provided on the gun. The ear lobe to be pierced is then cleansed with an antiseptic and positioned between the clasp holding-member 6 and the stud-holding member 7. This positioning is facilitated by the fact that the two members 6 and 7 are already sufficiently spaced apart for the purpose by virtue of the abutment of the frangible projecting stop 23 with the shoulder 24. In this way it is possible to avoid the step of manually separating the two members 6 and 7 and thereby exposing the customer whose ear is to be pierced to the risk of cross infection.

The person conducting the ear piercing operation next places the gun 1 into a pre-firing condition by squeezing the trigger during which process the stud-holding member 7 is drawn towards the clasp-holding member 6. At the same time the force exerted on the frangible projecting stop 23 by the shoulder 24 becomes sufficient to cause the stop to break away thereby allowing the two members 6 and 7 to move still closer together until further movement is prevented by the engagement of the shoulder 24 with the second projecting stop 25. The pressure at which the first projecting stop 23 breaks may be adapted so as to be relatively light so that the operator notices it but nevertheless does not have to exert to much force to break the stop. Alternatively, the force required to break the first stop 23 may be so slight as to be almost unnoticeable to the operator in comparison with that required to compress the trigger against the loading spring of the gun.

With the ear lobe now sandwiched between the clasp-holding member 6 and the stud-holding member 7, the operator fires the gun 1, either by further compression of the trigger if the gun is of the type shown in FIG. 1, or by actuating a separate firing trigger if the gun is provided with one that is separate from the spring loading trigger. As a result the plunger then engages the head of the stud 42 and drives the stud 3 through the ear and into engagement with the clasp 4. During the initial part of this process the stud 3 is guided by the through bore 16. When the comparatively wider shaft of the stud 40 engages the web 74, the fast moving stud 3 causes the web to break away. At the same time the comparatively wider head 42 engages the two inclined arms 19 again causing them to be broken away. The stud 3 is thus free to exit the stud housing 15 to penetrate the ear lobe. It will be apparent however, that in an alternative embodiment the bow-shaped portion 18 may simply break at the web 74 causing the two arms 19 to be deflected outwardly. In this way the stud 3 would be allowed to exit the stud housing 15 with the arms 19 still attached.

Having penetrated the ear lobe, the pointed end of the stud 44 engages the clasp 4 by penetrating the central aperture 48. In so doing the stud 3 engages the upper end of the projecting finger 72 causing the finger to be bent still further out of the plane of the back face 58 until it too breaks away.

After the gun has been fired the pressure on the trigger is released allowing the members 6 and 7 to move apart and so release the ear lobe. With the projecting finger 72 broken away from the clasp-holding member 6, the clasp 4 may be simply withdrawn from the transverse slot 62 by lowering the gun 1 away from the ear with the cartridge 2 still attached. Finally the two members of the cartridge 6 and 7 are removed from the gun 1 to be disposed of in any convenient manner leaving the gun ready for the next ear piercing operation.

In another embodiment shown in FIGS. 3 to 8, the foot portion 8 of the clasp-holding member 6 is additionally provided on its upper surface at an end remote from the post portion 9 with an elongated recess 30 whose longitudinal axis lies generally paralled to that of the foot portion itself. A frangible stop 23' is provided within the recess 30 which extends upwardly from a flat base of the recess to project beyond the upper surface of the foot portion 31. The stop 23' is located within the recess 30 such that the distance between the stop and the end of the recess adjacent to the post portion 9 is greater than the height of the stop.

In use this second embodiment operates in a very similar way to that previously described. The operation of this embodiment differs however in one respect, namely that as the trigger is squeezed and the two members of cartridge 6 and 7 move closer together, the force exerted by the shoulder 24 on the frangible stop 23' is such as cause the stop to partially break at its base and be hinged rearwardly toward the post portion 9. Continued relative movement of the two members 6 and 7 results in the stop 23' taking-up a position within the recess 30 in which it extends generally horizontally and below the level of the surface 31. In this way it is possible to ensure that any burr caused by the breaking of the stop 23' cannot interfere with the relative movement of the members 6 and 7. Likewise, the enforced retention of the stop 23° within the recess 30 avoids the danger of small fragmentary pieces of the apparatus breaking away and causing injury to either the operator or the customer.

It will be apparent that in an alternatively embodiment the frangible stop 23' may break away completely at its base while still being retained within the recess 30.

Figure 3:
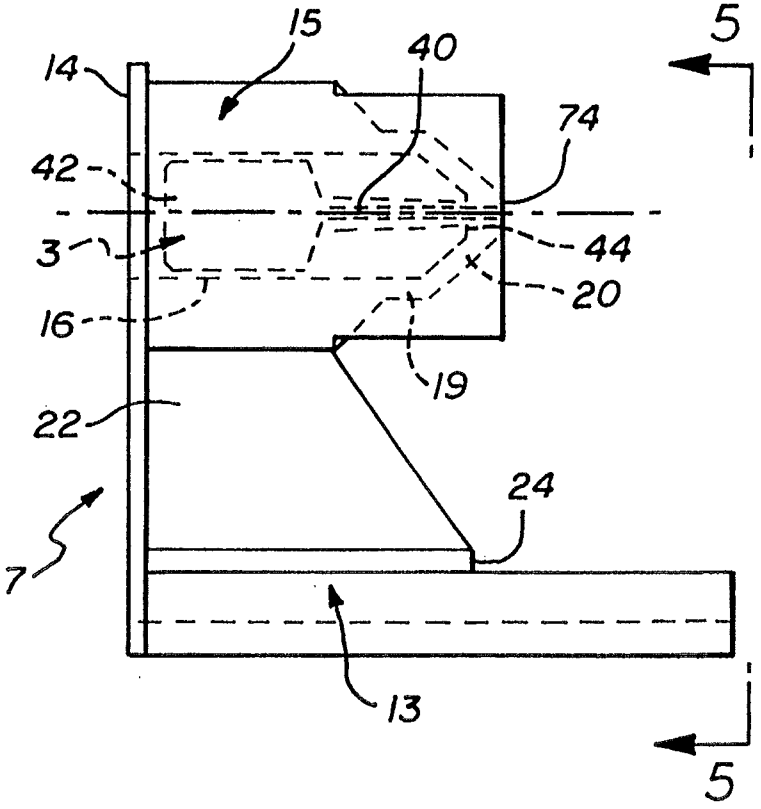
FIG. 3 is a lateral side view of a stud-holding member of a cartridge in accordance with a second embodiment of the present invention.
Figure 5:
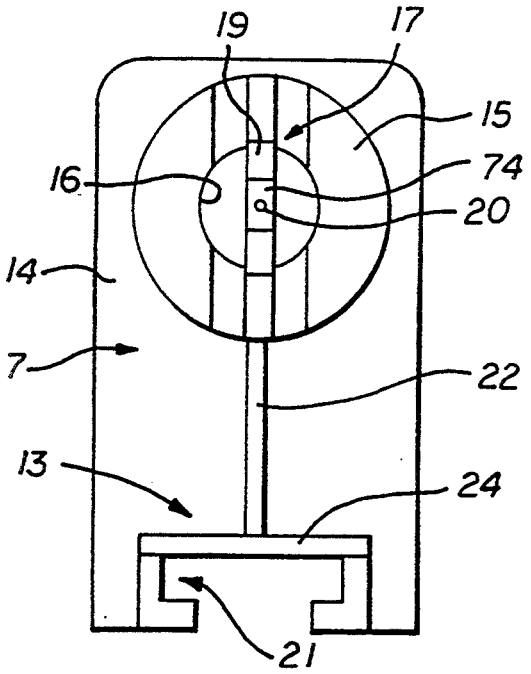
FIG. 5 is an end view of the stud-holding member of FIG. 3 taken along line 5—5.
Figure 6:
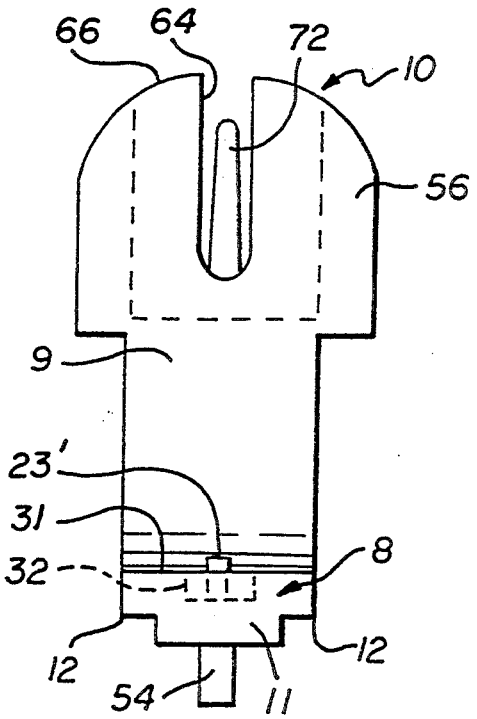
FIG. 6 is an end view of the clasp-holding member of FIG. 4 taken along line 6—6.
Figure 7:
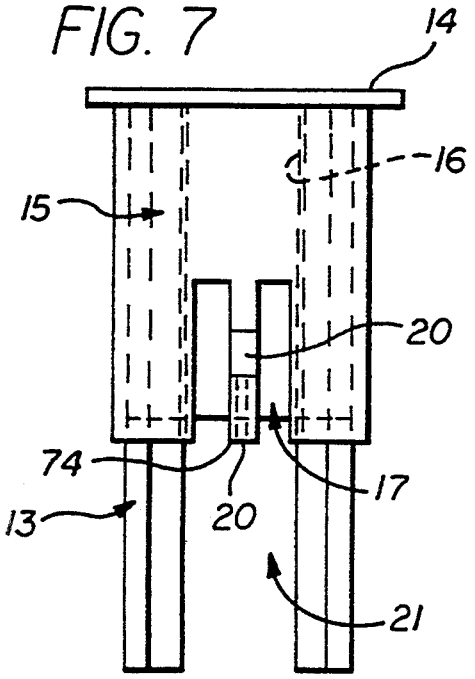
FIG. 7 is a plan view of the stud-holding member of FIG. 3.
Figure 8:
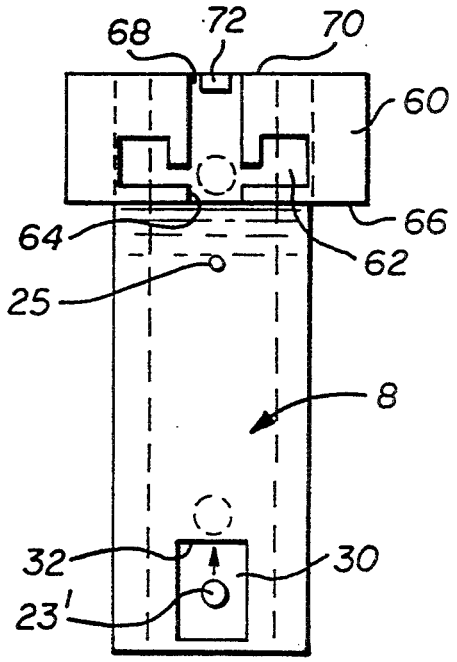
FIG. 8 is a plan view of the clasp-holding member of FIG. 4.

It will also be apparent that the stud housing 15 need not necessarily be of frustroconical shape. Instead the housing may be substantially cylindical as shown in FIGS. 3, 5 and 7.

Figure 10:
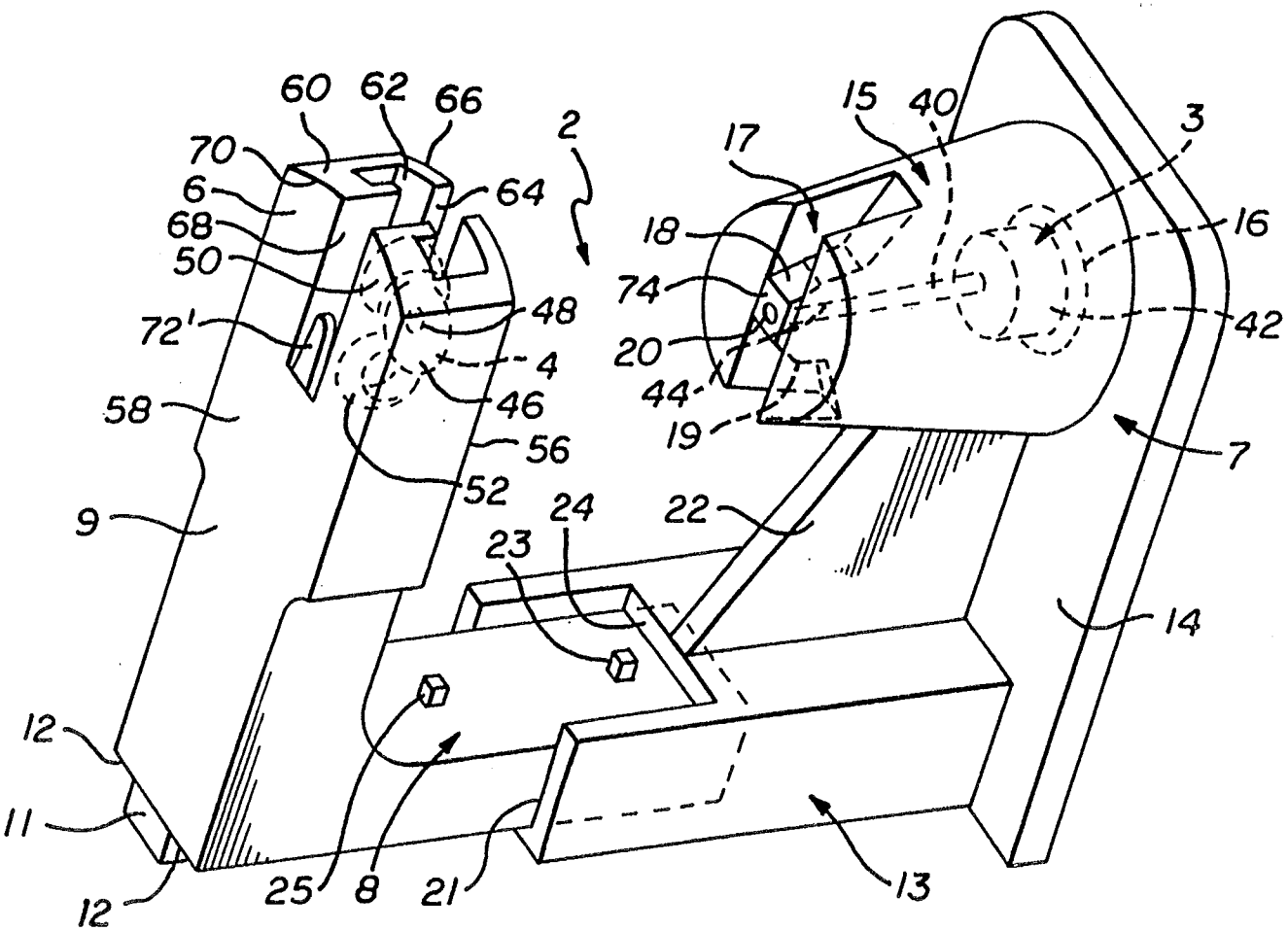
FIG. 10 is a schematic perspective view of a cartridge in accordance with a third embodiment of the present invention.

In a further embodiment shown in FIG. 10, the post portion 9 of the clasp-holding member 6 can be seen to comprise a projecting finger 72' of somewhat smaller dimensions than that shown in FIG. 2 such that in use the finger does not overlie the central aperture 48 of the clasp 4. The finger 72' is nevertheless able to engage the lower of the two arcuate spring portions 50 or 52 and so retain the clasp 4 within the clasp-holding member 6. Upon firing of the gun 1 the pointed end of the stud 44 engages the clasp 4 with an impact that forces the clasp rearwardly within the transverse slot 62. This impact is sufficient to cause the projecting finger 72' which is already under stress to break away from the clasp-holding member 6 thereby facilitating the easy withdrawal of the clasp 4 from the cartridge 2.

It will be apparent that with either design of projecting finger 72 or 72', the finger may be shaped so as to conform the shape of either or both of the two arcuate spring portions 50 or 52 with which it is initially in contact.

It will also be apparent that the provision of a second stop 25 on the foot portion 8 is not essential and so may be omitted in certain embodiments.

I claim:

1. A cartridge for an ear piercing apparatus of the type comprising means to propel a stud through an ear and into engagement with a clasp, said cartridge comprising a clasp-holding member having means for holding the clasp, and a stud-holding member having means for holding the stud, one of said members having a guide formation which cooperates with a complimentary guide formation provided on the other of said members so as to facilitate relative movement of said members in a direction generally parallel to the direction of propulsion of the stud, said means for holding the clasp comprising means defining a slot within the clasp holding member for the receipt of the clasp and retaining means for releasable engagement with the clasp when the clasp is received within the slot said retaining means comprising a resilient projecting finger which overlies at least a portion of the slot and which is stressed by the receipt of the clasp within the slot, the restoring force acting on the finger causing the finger to engage the clasp in such a way as to retain the clasp within the slot.

2. A cartridge in accordance with claim 1, wherein the clasp is provided with means defining a central aperture and the finger overlies said central aperture when the clasp is received within the slot.

3. A cartridge in accordance with claim 1, wherein said finger is frangible.

4. A cartridge in accordance with claim 3, wherein said finger breaks away from the clasp-holding member upon engagement of the stud with said finger.

5. A cartridge in accordance with claim 3, wherein said finger breaks away from the clasp-holding member upon engagement of the stud with the clasp.

6. A cartridge in accordance with claim 1, wherein said means for holding the stud comprises means defining a bore for the receipt of the stud and web means partially closing said bore, said web means including means defining an aperture therein for the receipt of a portion of the stud.

7. A cartridge in accordance with claim 1, wherein a first of the members is provided with a peg which projects from said member and cooperates with a shoulder provided on the other of the members so as to prevent the members moving towards each other closer than a predetermined distance defined by the peg and shoulder at least during the adaptation of the cartridge to the gun to enable an ear lobe to be inserted between the stud and the clasp, the peg being frangible upon a pre-firing operation of the gun to allow the peg and shoulder to move beyond each other and the two members to move together closer than said predetermined distance.

8. A cartridge in accordance with claim 7, wherein the predetermined distance is such that the cartridge has an overall length which is substantially complimentary to the available space for the cartridge on the gun.

9. A cartridge in accordance with claim 7, wherein said first member defines a recessed portion in which the peg is provided, the peg projecting out of the recess.

10. A cartridge in accordance with claim 9, wherein the recess has a longitudinal extent in the direction of relative motion of the members which is large enough to enable the peg to be displaced into the recess when it is broken upon operation of the gun.

11. A cartridge in accordance with claim 9, wherein the peg is adapted to be fractured and displaced during the operation of the gun but still at least partially joined to said first of the members.

12. A cartridge in accordance with claim 1, wherein the two members have longitudinally extending feet portions which define said guide formation and said complimentary guide formation.

13. A cartridge in accordance with claim 1, wherein said guide formation and said complimentary guide formation comprise a male tongue running in a female channel.

14. A cartridge in accordance with claim 1, wherein the stud-holding member is adapted for use with a stud having a relatively wide body portion and a relatively narrow shaft portion which in use pierces the ear, the stud-holding member having stud guide means at an inward end thereof which in use is disposed adjacent to the ear, said stud guide means guiding the shaft portion of the stud.

15. A cartridge in accordance with claim 14, wherein said stud guide means comprises a frangible guide element which in use breaks away from the stud-holding member.

16. A cartridge in accordance with claim 15, wherein said frangible guide means comprises a bow formation having to mutually inclined arms, a passage being defined at a central region of the bow formation whereby the stud takes a form of an arrow being guided by and passing through the passage in the bow.

17. A cartridge in accordance with claim 1 and including a clasp held by said clasp-holding member and a stud held by said stud-holding member.

18. A method of piercing an ear comprising the steps of fitting a cartridge in accordance with claim 1 to an ear piercing gun, disposing an ear to be pierced between the members of the cartridge, actuating the gun so as to cause the stud contained in the stud-holding member to penetrate the ear and engage the clasp contained in the clasp-holding member, and causing the retaining means to break away from the clasp-holding member so as to allow the clasp to be removed therefrom.

19. A cartridge for an ear piercing apparatus of the type comprising means to propel a stud through an ear and into engagement with a clasp, said cartridge comprising a clasp holding member having means for holding the clasp, and a stud holding member having means for holding the stud, one of said members having a guide formation which cooperates with a complimentary guide formation provided on the other of said members so as to facilitate relative movement of said members in a direction generally parallel to the direction of propulsion of the stud, the clasp having means defining a central aperture and said means for holding the clasp comprising means defining a slot within the clasp holding member for the receipt of the clasp and retaining means for releasable engagement with the clasp when the clasp is received within the slot, said retaining means comprising a resilient formation which overlies said central aperture when the clasp is received within the slot and which is stressed upon said receipt, the restoring force acting on the resilient formation causing the formation to engage the clasp in such a way as to retain the clasp within the slot.

20. A cartridge for an ear piercing apparatus of the type comprising means to propel a stud through an ear and into engagement with a clasp, said cartridge comprising a clasp holding member having means for holding clasp, and a stud holding member having means for holding the stud, one of said members having a guide formation which cooperates with a complimentary guide formation provided on the other of said members so as to facilitate relative movement of said members in a direction generally parallel to the direction of propulsion of the stud, said means for holding the clasp comprising means defining a slot within the clasp holding member for the receipt of the clasp and retaining means for releasable engagement with the clasp when the clasp is received within the slot, said retaining means comprising a resilient but frangible formation which is stressed by the receipt of the clasp within the slot such that the resorting force acting on the resilient formation causes the formation to engage the clasp in such a way as to retain the clasp within the slot but which breaks away from the clasp holding member upon the engagement of the stud with the clasp.

* * * * *